US006007962A

United States Patent [19]

Pearce et al.

[11] Patent Number: 6,007,962

[45] Date of Patent: Dec. 28, 1999

[54] SPACER BEADS FOR LASER ABLATIVE IMAGING

[75] Inventors: Glenn T. Pearce, Rochester; Paul E. Woodgate, Spencerport, both of N.Y.

[73] Assignee: Eastman Kodak Company, Rochester, N.Y.

[21] Appl. No.: 09/094,804

[22] Filed: Jun. 15, 1998

[51] Int. Cl.[6] ..... B41M 5/035

[52] U.S. Cl. ..... 430/269; 430/945; 430/201; 430/200; 503/227

[58] Field of Search ..... 503/227; 430/945, 430/200, 201, 269

[56] References Cited

U.S. PATENT DOCUMENTS

| | | | |
|---|---|---|---|
| 4,541,830 | 9/1985 | Hotta et al. | 8/471 |
| 4,876,235 | 10/1989 | DeBoer et al. | 503/227 |
| 4,973,572 | 11/1990 | DeBoer | 430/200 |
| 5,234,891 | 8/1993 | Burberry et al. | 430/200 |
| 5,254,524 | 10/1993 | Guittard et al. | 503/227 |
| 5,291,218 | 3/1994 | DeBoer | 503/227 |
| 5,334,575 | 8/1994 | Noonan et al. | 503/227 |
| 5,468,591 | 11/1995 | Pearce et al. | 430/200 |
| 5,516,622 | 5/1996 | Savini et al. | 430/200 |
| 5,538,935 | 7/1996 | Hastreiter, Jr. et al. | 503/227 |
| 5,670,449 | 9/1997 | Simpson et al. | 503/227 |
| 5,759,741 | 6/1998 | Pearce et al. | 430/200 |
| 5,786,298 | 7/1998 | Tsou et al. | 503/227 |

FOREIGN PATENT DOCUMENTS

| | | |
|---|---|---|
| 0698503 | 2/1996 | European Pat. Off. . |

OTHER PUBLICATIONS

U.S. application Ser. No. 08/295,315 filed Aug. 24, 1994 of Tutt et al, "Abrasion–Resistant Overcoat Layer for Laser Ablative Imaging", (copy not enclosed).

*Primary Examiner*—Martin Angebranndt
*Attorney, Agent, or Firm*—Harold E. Cole

[57] ABSTRACT

An ablative recording element comprising a support having thereon a dye layer comprising a dye dispersed in a polymeric binder and solvent, the dye layer having an infrared-absorbing material associated therewith, and wherein the dye layer also contains dye-absorbing beads which can be:

a) polymeric beads which are swellable in the solvent and which are covalently crosslinked to an extent which does not exceed $1\times10^{-4}$ mole of crosslink per gram of polymer; or b) beads which have a porosity of at least 150 $m^2$/gram.

16 Claims, No Drawings

SPACER BEADS FOR LASER ABLATIVE IMAGING

FIELD OF THE INVENTION

This invention relates to the use of certain spacer beads in a laser ablative recording element.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

In one ablative mode of imaging by the action of a laser beam, an element with a dye layer composition comprising an image dye, an infrared-absorbing material, and a binder coated onto a substrate is imaged from the dye side. The energy provided by the laser drives off substantially all of the image dye and binder at the spot where the laser beam hits the element. In ablative imaging, the laser radiation causes rapid local changes in the imaging layer thereby causing the material to be ejected from the layer. Ablation imaging is distinguishable from other material transfer techniques in that some sort of chemical change (e.g., bond-breaking), rather than a completely physical change (e.g., melting, evaporation or sublimation), causes an almost complete transfer of the image dye rather than a partial transfer. The transmission Dmin density value serves as a measure of the completeness of image dye removal by the laser.

Elements used in the graphic arts often contain spacer beads on the top surface or backside to facilitate sliding and ease of handling. In particular, these spacer beads often enable a vacuum to be readily created between the element and a supporting glass surface in order to hold the element firmly and uniformly in place when mounted on various exposure devices. The ability of such a vacuum to be established is known as "vacuum drawdown".

DESCRIPTION OF RELATED ART

U.S. Pat. No. 5,516,622 relates to a laser-induced ablative transfer element wherein the ablative layer contains a particulate filler. U.S. patent application Ser. No. 08/295,315 relates to a laser dye removal element wherein particles are contained in an overcoat or surface layer to improve scratch resistance. U.S. Pat. No. 5,759,741 relates to a laser dye removal element wherein particles are contained in a barrier layer between the support and imaging layer.

However, there is a problem with the particles in these elements in that the particles may be lost due to stress or may protrude through the imaging layer resulting in pinholes or repellency spots. Another problem with particles contained in an imaging layer of a laser dye removal element is that such particles create pinholes in the imaging layer which result in a "starry night" appearance of the image area remaining after ablative dye removal. When used as a masking film on a negative-working printing plate, those pinholes cause dark spots against a light or Dmin background on the resulting printing plate, and as light spots against a dark area in positive-working plates, spoiling the printed image produced by the printing plate.

It is an object of this invention to provide an ablative recording element which has adequate "vacuum drawdown" properties. It is another object of this invention to provide an ablative recording element wherein particles are employed without the "starry night" or pinhole problems. It is another object of this invention to provide an ablative recording element wherein particles which are employed are less susceptible to removal by physical stresses.

SUMMARY OF THE INVENTION

These and other objects are achieved in accordance with the invention which comprises an ablative recording element comprising a support having thereon a dye layer comprising a dye dispersed in a polymeric binder and solvent, the dye layer having an infrared-absorbing material associated therewith, and wherein the dye layer also contains dye-absorbing beads which can be:

a) polymeric beads which are swellable in the solvent and which are covalently crosslinked to an extent which does not exceed $1\times10^{-4}$ mole of crosslink per gram of polymer; or b) beads which have a porosity of at least 150 $m^2$/gram.

By use of the invention, beads in the dye layer absorb dyes present during the coating process of manufacture. Enough dye is absorbed by the beads so that no pinholes are produced, yet the dyes are removable during the dye removal process to provide an adequate Dmin for a printing plate exposure process.

An additional advantage of using the beads of the invention in the dye layer for vacuum drawdown is that they are much less susceptible to removal by physical stresses, such as rubbing or scratching, since the beads are intimately mixed with the other materials in the dye layer.

DESCRIPTION OF THE PREFERRED EMBODIMENTS

The dye-absorbing beads employed in this invention can be one of two distinct types. The "type I" beads are lightly crosslinked, swellable polymer particles with a molar crosslink density that does not exceed $1\times10^{-4}$ mole of crosslink per gram of polymer. The crosslinks may be formed either by a chemical reaction between polymer chains resulting in covalent bond formation or by the association of ionic groups. In a preferred embodiment, the beads or particles are prepared by suspension polymerization by heating stabilized monomer droplets containing a thermal initiator to achieve polymerization. The monomer droplets also contained no more than $1\times10^{-4}$ moles of di- or multifunctional monomer per gram of total monomer to provide the covalent crosslinks. The particles may also be formed by grinding to the appropriate particle size, preformed and precrosslinked bulk polymer by any convenient mechanical means.

The polymeric particles of type I may be of any chemical nature as long as they are swellable by the coating solvent used to coat the dye layer, and preferably would be totally soluble in the coating solvent if the crosslinks were not present. Preferred polymers include liquid monomers such as vinyl alkyl acrylates and methacrylates, vinyl esters and vinyl aromatics, mono- and di-N-alkyl acrylamides and methacrylamides and may include those listed in Tables 1 and 2 below, namely styrene, t-butylstyrene, butyl acrylate, and methyl methacrylate, with divinylbenzene and ethylene dimethacrylate as the crosslinking monomers. The particles may also be spherical, elliptical, or irregular in shape, and may present a polydisperse or a monodisperse size distribution.

The second type of dye-absorbing beads employed in this invention, "type II", may be of similar or identical chemical nature as the polymers of type I, with the proviso that these particles are highly porous. The preferred particles, such as those listed in Table 2, when included in the dye layer of the ablative recording element give rise to pin-hole free images when the porosity of the beads is equal to or exceeds 150 $m^2$/gram. These porous particles need not be swellable in the coating solvent as are the above type I particles, as long as they provide the requisite surface area and are of the correct size and number to provide vacuum drawdown.

The dye-absorbing beads used in the invention may be employed in any amount useful for the intended purpose. In general, good results have been obtained at a coverage of from about 0.004 g/$m^2$ to about 0.1 g/$m^2$.

The dye layer employed in this invention may be employed at a thickness of from about 0.25 to about 5 $\mu$m, corresponding to about 0.25 to about 5 g/$m^2$, preferably from 1 to about 2 g/$m^2$. The average bead diameter is preferably about twice the thickness of the dye layer, preferably from about 2 to about 5 $\mu$m.

The ablative recording elements of the invention may optionally contain an outer protective layer over the dye layer which is preferably comprised of a water-soluble binder, water-dispersible lubricant particles such as Teflon®, a surfactant, and optionally an infrared-absorbing dye. Suitable overcoat layers are described in U.S. Pat. Nos. 5,459,017 and 5,468,591.

The dye-absorbing beads of the invention may also be included in an overcoat layer comprising a binder such as that used in the dye layer and the same solvent used for the binder and dyes of the dye layer. When coated in this manner, optically-magnified cross sections of the combined image layer and bead-containing overcoat were indistinguishable from coatings where the beads had been included in the image layer only. It is believed that the solvent used in the overcoat dissolved all components of both layers before drying, leaving the beads resting at the interface between the sub layer and the dye layer, with the tops of the beads protruding through the combined dye layer and overcoat, providing they were large enough.

The ablative recording elements of this invention can be used to obtain medical images, reprographic masks, printing masks, etc. The image obtained can be a positive or a negative image and can be either continuous (photographic-like) or halftone.

The invention is especially useful in making reprographic masks which are used in publishing and in the generation of printed circuit boards The masks are placed over a photosensitive material, such as a printing plate, and exposed to a light source. The photosensitive material usually is activated only by certain wavelengths. For example, the photosensitive material can be a polymer which is crosslinked or hardened upon exposure to ultraviolet or blue light but is not affected by red or green light. For these photosensitive materials, the mask, which is used to block light during exposure, must absorb all wavelengths which activate the photosensitive material in the Dmax regions and absorb little in the Dmin regions. For printing plates, it is therefore important that the mask have high UV Dmax. If it does not do this, the printing plate would not be developable to give regions which take up ink and regions which do not.

Any polymeric material may be used as the binder in the recording element employed in the process of the invention. For example, there may be used cellulosic derivatives, e.g., cellulose nitrate, cellulose acetate hydrogen phthalate, cellulose acetate, cellulose acetate propionate, cellulose acetate butyrate, cellulose triacetate, a hydroxypropyl cellulose ether, an ethyl cellulose ether, etc., polycyanoacrylates; polycarbonates; polyurethanes; polyesters; poly(vinyl acetate); poly(vinyl halides) such as poly(vinyl chloride) and poly(vinyl chloride) copolymers; poly(vinyl ethers); maleic anhydride copolymers; polystyrene; poly(styrene-co-acrylonitrile); a polysulfone; a poly(phenylene oxide); a poly(ethylene oxide); a poly(vinyl alcohol-co-acetal) such as poly(vinyl acetal), poly(vinyl alcohol-co-butyral) or poly (vinyl benzal); or mixtures or copolymers thereof. The binder may be used at a coverage of from about 0.1 to about 5 g/$m^2$.

In a preferred embodiment, the polymeric binder used in the recording element employed in process of the invention has a polystyrene equivalent molecular weight of at least 100,000 as measured by size exclusion chromatography, as described in U.S. Pat. No. 5,330,876.

A subbing or barrier layer may be employed in the invention between the support and imaging layer. The barrier layer may be, for example, gelatin, poly(vinyl alcohol), or polycyanoacrylate as described in U.S. Pat. Nos. 5,459,017 and 5,468,591 and U.S. patent application Ser. No. 08/797,221 referred to above. The subbing or barrier layer may be coated at from about 0.05 g/$m^2$ to about 1/0 g/$m^2$, preferably from about 0.2 to about 0.7 g/$m^2$.

To obtain a laser-induced, ablative image using the process of the invention, a diode laser is preferably employed since it offers substantial advantages in terms of its small size, low cost, stability, reliability, ruggedness, and ease of modulation. In practice, before any laser can be used to heat an ablative recording element, the element must contain an infrared-absorbing material, such as pigments like carbon black, or cyanine infrared-absorbing dyes as described in U.S. Pat. No. 4,973,572, or other materials as described in the following U.S. Pat. Nos.: 4,948,777, 4,950,640, 4,950,639, 4,948,776, 4,948,778, 4,942,141, 4,952,552, 5,036,040, and 4,912,083, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the dye, but also on the ability of the dye layer to absorb the radiation and convert it to heat. The infrared-absorbing material or dye may be contained in the dye layer itself or in a separate layer associated therewith, i.e., above or below the dye layer. The infrared-absorbing materials can be present in the dye layer or a contiguous layer at between 2 and 75 wt-%, relative to the binder polymer, and preferably between 10 and 50 wt-%. As noted above, the laser exposure in the process of the invention takes place through the dye side of the ablative recording element, which enables this process to be a single-sheet process, i.e., a separate receiving element is not required.

Lasers which can be used in the invention are available commercially. There can be employed, for example, Laser Model SDL-2420-H2 from Spectra Diode Labs, or Laser Model SLD 304 V/W from Sony Corp.

Any dye can be used in the ablative recording element employed in the invention provided it can be ablated by the action of the laser. Especially good results have been obtained with dyes such as disclosed in U.S. Pat. Nos. 4,541,830; 4,698,651; 4,695,287; 4,701,439; 4,757,046; 4,743,582; 4,769,360; and 4,753,922, the disclosures of which are hereby incorporated by reference. The above dyes may be employed singly or in combination. The dyes may be used at a coverage of from about 0.05 to about 1 $g/m^2$ and are preferably hydrophobic.

Pigments which may be used in the dye layer of the ablative recording layer of the invention include carbon black, graphite, metal phthalocyanines, etc. When a pigment is used in the dye layer, it may also function as the infrared-absorbing material, so that a separate infrared-absorbing material does not have to be used.

The dye layer of the ablative recording element employed in the invention may be coated on the support or printed thereon by a printing technique such as a gravure process.

Any material can be used as the support for the ablative recording element employed in the invention provided it is dimensionally stable and can withstand the heat of the laser. Such materials include polyesters such as poly(ethylene naphthalate); poly(ethylene terephthalate); polyamides; polycarbonates; cellulose esters such as cellulose acetate; fluorine polymers such as poly(vinylidene fluoride) or poly (tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 mm. In a preferred embodiment, the support is transparent.

The following examples are provided to illustrate the invention.

EXAMPLES

Beads—Type 1

In the examples that follow, swellable crosslinked particles of type I, which are listed in Table 1, were prepared by suspension polymerization whereby the crosslinks were formed by inclusion of difunctional monomers in the suspended monomer droplets. Invention example particles I-1 contain less than $1\times10^{-4}$ moles of difunctional monomer (divinylbenzene) per gram of total monomer, whereas the control examples, C-1, C-2 and C-3 contain more than $1\times10^{-4}$ moles of difunctional monomer as indicated in Table 1. C-1 is a micronized polyethylene/polypropylene wax as an example of a non-swellable or non-soluble particle as used in the above-cited U.S. Pat. No. 5,759,741.

TABLE 1

Type I Swellable Crosslinked Beads

| | Beads | Mean Diameter (μm) | Crosslink Density moles/gm |
|---|---|---|---|
| I-1 | 98/1/1 (wt/wt.) styrene/butyl acrylate/divinylbenzene terpolymer | 4 | $7.69 \times 10^{-5}$ |
| C-1 | micronized polyethylene, polypropylene, and oxidized polyethylene wax (S-363 from Shamrock Technologies) | 5 | Non-Soluble Non-Swellable |
| C-2 | 95/5 (wt/wt) styrene/divinylbenzene copolymer | 4 | $3.85 \times 10^{-4}$ |
| C-3 | 70/10/20 (wt/wt) styrene/butyl crylate/divinylbenzene terpolymer | 4 | $7.69 \times 10^{-4}$ |

Beads—Type II

The bead particles of type II were also made by suspension polymerization, but unlike the particles of type I, these beads contained large amounts of di- or multifunctional monomers up to and including 100% of the monomer droplets. Porosity was obtained by including in the monomer droplets an inert diluent or porogen, such as pentyl alcohol, which simultaneously serves as solvent for the monomers and as non-solvent for the resulting polymer.

Phase separation taking place during the polymerization process resulted in pore formation within the particles. After polymerization, the inert diluent was extracted using methanol, and the beads were dried leaving permanent pores. Further information on bead preparation can be found in the following reference: A. Guyot "Synthesis and Separations Using Functional Polymers", edited by D. C. Sherrington and P. Hodge, pp. 11–20; John Wiley and Sons, New York, 1988.

The type II porous beads were analyzed for porosity using values of the specific surface area by a gas adsorption technique. The specific surface area of the beads was based on nitrogen gas adsorption at −195° C. The previously degassed sample was subjected to a flowing mixture of helium carrier gas and nitrogen adsorbate gas. The amount of nitrogen adsorbed/desorbed was used in the Brunauer, Emmett, Teller (B.E.T.) equation to calculate the specific surface area in units of $m^2$/gram. The porous bead particles used in this invention are listed in Table 2 along with the specific surface areas measured as described. The control examples were prepared by the identical procedure, except that the pentyl alcohol diluent or porogen was not included in the suspended monomer droplets.

TABLE 2

Type II Beads

| | Beads | Mean Diameter (μm) | Specific Surface Area ($m^2$/g) |
|---|---|---|---|
| I-2 | 100 (wt. %) divinylbenzene | 4 | 559 |
| I-3 | 50/50 (wt/wt) styrene/divinylbenzene copolymer | 5.2 | 177 |

TABLE 2-continued

| Type II Beads | | | |
|---|---|---|---|
| | Beads | Mean Diameter (μm) | Specific Surface Area ($m^2/g$) |
| I-4 | 56/44 (wt/wt) t-butylstyrene/divinyl-benzene | 5.6 | 413 |
| I-5 | 50/50 (wt/wt) methyl methacrylate/ethylene dimethacrylate | 4 | 97.4 |
| I-6 | 100% ethylene dimethacrylate | 4 | 343 |
| C-4 | 100 (wt %) divinylbenzene | 4 | nonporous |
| C-5 | 50/50 (wt/wt) methyl methacrylate/ethylene dimethacrylate | 4 | nonporous |
| C-6 | 100% ethylene dimethacrylate | 4 | nonporous |
| C-7 | Tospearl 130 ® (Silicone Beads)* | 3 | 20 |
| C-8 | Tospearl 145 ® (Silicone Beads)* | 4.5 | 20 |

*Tospearl ® Beads are manufactured by Toshiba Silicones and distributed by GE Silicones. The surface areas were supplied by the manufacturer.

Coating Examples 1–6

The elements of this experimental series contained type 1 beads of the invention in a solvent overcoat over the imaging layer as described above in a manner that allowed the beads to settle in the imaging layer after drying.

The following materials were employed in these examples:

IR-Absorbing Dye IR-1

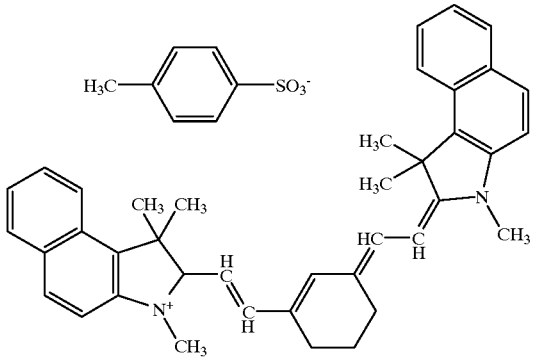

Curcumin Yellow Dye

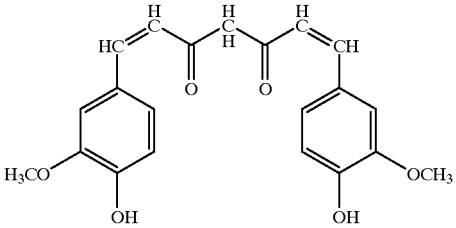

UV-Absorbing Dye UV-1

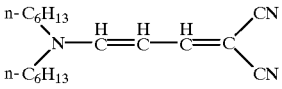

UV-Absorbing Dye UV-2

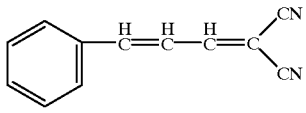

-continued

Cyan Dye 1

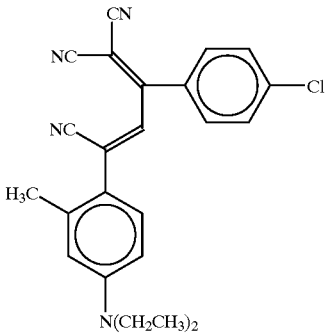

Cyan Dye 2

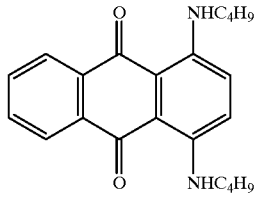

Coating Example 1—No Bead Control

A 100 μm thick poly(ethylene terephthalate) support was coated with 0.38 $g/m^2$ of the copolymer of 30% ethyl cyanoacrylate and 70% methyl cyanoacrylate, 0.05 $g/m^2$ infrared dye IR-1, and 0.005 $g/m^2$ FC 431® surfactant (3M Corp.) from a acetonitrile. A second or imaging layer was coated on top consisting of 0.22 $g/m^2$ IR-1, 0.60 $g/m^2$ nitrocellulose, 0.29 $g/m^2$ Curcumin yellow dye, 0.13 $g/m^2$ of UV-1, and 0.16 $g/m^2$ of Cyan dye 2 was coated from an 80/20 (wt/wt) mixture of 4methyl-2-pentanone and denatured ethanol.

Coating Example 2—Nonswellable Beads

On the support, sub layer, and imaging layer of Example 1 was coated a bead-bearing layer comprising 0.11 $g/m^2$ nitrocellulose (1000–1500 s viscosity), 0.011 $g/m^2$ IR-1, and 0.022 $g/m^2$ bead C-1 from n-butyl acetate.

Coating Examples 3–6—Crosslinked Swellable Beads

A 100 μm thick poly(ethylene terephthalate) support was coated with the sub layer of Examples 1–2 and subsequently coated with a dye layer comprising 0.6 $g/m^2$ nitrocellulose, 0.14 $g/m^2$ UV-2, 0.29 $g/m^2$ Curcumin yellow dye, 0.38 $g/m^2$ Cyan dye 1, and 0.22 $g/m^2$ IR-1 from an 80/20 mixture (wt/wt) of 4-methyl-2-pentanone and denatured ethanol. Over the dye layer was coated a bead-bearing layer comprising 0.05 $g/m^2$ nitrocellulose, 0.005 $g/m^2$ BYK 333 surfactant (BYK-Chemie), and 0.011 $g/m^2$ beads according to the entries in Table 3 from an 80/20 mixture of 4-methyl-2-pentanone. The overcoat for Example 3 contained no beads.

The coated elements of Examples 1-6 were all imaged with a diode laser imaging device as described in U.S. Pat. No. 5,268,708. Each of the coatings was ablation written using a laser diode print head, where each laser beam has a wavelength range of 830–840 nm and a nominal power output of 600 mW at the film plane. The drum, 53 cm in circumference was rotated at varying speeds and the imaging electronics were activated to provide adequate exposure. The translation stage was incrementally advanced across the dye ablation element by means of a lead screw turned by a microstepping motor, to give a center-to-center line distance of 10.58 μm (945 lines per centimeter or 2400 lines per inch). An air stream was blown over the dye ablation element surface to remove the ablated dye. The ablated dye and other effluents are collected by suction. The measured total power at the focal plane was 600 mW per channel. At a rotation of 1040 rpm, the exposure was about 620 mj/cm$^2$. The vacuum drawdown properties were determined by the method described in the above-cited co-pending U.S. Ser. No. 08/797,221. All coatings containing beads were shown to provide adequate to excellent vacuum drawdown times, with the better drawdown afforded by the larger beads. The following results were obtained:

TABLE 3

Type I Beads in a Solvent Overcoat

| Coating Example | Beads | UV density Change[1] | Crosslink Density[2] moles/gram |
|---|---|---|---|
| 1 | None[3] | — | — |
| 2 | C-1 | −0.375 | — |
| 3 | None[4] | — | — |
| 4 | C-2 | −0.36 | $3.85 \cdot 10^{-4}$ |
| 5 | C-3 | −0.42 | $1.54 \cdot 10^{-3}$ |
| 6 | I-1 | 0.13 | $7.69 \cdot 10^{-5}$ |

[1]Difference between the no-particle comparison and the coating entry
[2]Moles of crosslinking monomer per gram of total monomer as added to the polymerization mixture
[3]No-particle check for coating Example 2: UV density was 3.75
[4]No-particle check for coating Examples 4–6: UV density was 4.50

The above results show that the element containing the invention beads (I-1) appeared to have no or only very few pinholes on visual inspection. This was confirmed by measuring the UV density recorded on an X-Rite densitometer Model 310 (X-Rite Co.) of the elements before imaging, or in the Dmax areas after imaging, and comparing the value with the UV density of the comparison elements with no beads. As described in U.S. Pat. No. 5,759,741, a UV density loss of 0.1 O.D. or less in an element containing beads relative to a no-bead comparative check indicated an acceptable low level of pinholes. The element containing the invention beads (I-1) met this criterion, whereas the comparative examples containing either the nonswellable beads (C-1) or the swellable types (C-2 and C-3) with the higher crosslink densities showed a significant Dmax loss.

Coating Examples 7–14

The ablative recording elements of this experimental series type II porous beads of this invention in a solvent overcoat over the imaging layer as described above in a manner that allowed the beads to settle in the imaging layer during drying.

Coated elements Examples 7–14 were identical in structure to coated elements Examples 3–6 with the beads as identified in Table 3, and with the further exception that the bead laydown in Examples 7–12 was 0.0071 g/m$^2$ and 0.032 g/m$^2$ in Examples 13 and 14. As for Examples 3–6, coated element Example 3 with an overcoat containing no beads was used as the control. The following results were obtained:

TABLE 4

Coating Examples 7–14
Type II Porous Beads in a Solvent Overcoat

| Coating Example | Beads | UV density Change[1] | Specific Surface Area |
|---|---|---|---|
| 3 | None[2] | — | — |
| 7 | C-4 | −0.61 | nonporous |

TABLE 4-continued

Coating Examples 7–14
Type II Porous Beads in a Solvent Overcoat

| Coating Example | Beads | UV density Change[1] | Specific Surface Area |
|---|---|---|---|
| 8 | I-2 | −0.03 | 559 m$^2$/g |
| 9 | C-5 | −0.32 | nonporous |
| 10 | I-5 | −0.27 | 97.4 m$^2$/g |
| 11 | C-6 | −0.41 | nonporous |
| 12 | I-6 | −0.08 | 343 m$^2$/g |
| 13 | C-7 | −0.62 | 20 |
| 14 | C-8 | −0.81 | 20 |

[1]Difference between the no-particle check and the coating entry
[2]No-particle check for coating Examples 4–14: UV density was 4.50

The above data show that the elements from Examples 7–14 all gave acceptable Dmin's upon imaging and adequate to excellent vacuum drawdown times. The examples with porous beads I-2, and I-6 both gave acceptable low levels of UV density loss indicating a low level of pinholes. Although in Example 10 which contained porous beads I-5 the surface area was below the 150 m$^2$/gm requirement, the resulting density loss was unacceptable as it was above the 0.1 limit. Overall, the data in Table 3 demonstrate the ability of the porous beads of this invention to absorb dye during coating compared to their nonporous counterparts.

Coating Examples 15–19

These elements contained both type I swellable crosslinked beads and type II porous beads in the dye layer.

On a 100 $\mu$m thick poly (ethylene terephthalate) film was coated a sub layer identical to that used in Examples 1–14 above. Over the sub layer was coated a dye layer identical to that used in Examples 7–14, with the exception that the beads were included in these dye layers as indicated in Table 4 at a coverage of 0.022 g/m$^2$. Coating Example 15 contained no beads.

TABLE 5

Coating Examples 15–19
Type I and II Beads in the Imaging Layer

| Coating Example | Beads | UV Density Change[1] | Specific Surface Area | Crosslink Density[2] moles/gram |
|---|---|---|---|---|
| 15 | None[3] | — | — | — |
| 16 | C-2 | −0.185 | nonporous | $3.85 \cdot 10^{-4}$ |
| 17 | I-1 | −0.053 | nonporous | $7.69 \cdot 10^{-5}$ |
| 18 | I-4 | 0.009 | 413 | — |
| 19 | I-3 | −0.006 | 177 | — |

[1]1 Difference between the no-particle check and the coating entry
[2]No-particle check coating for coating Examples 16–19: UV density was 3.16
[3]Moles of crosslinking monomer per gram of total monomer as added to the polymerization mixture The above data show that that the beads of the invention may be contained directly in the dye layer and may absorb enough dye to prevent the formation of pinholes as demonstrated by the low density losses for the invention examples. All of the coatings gave acceptable Dmin's upon imaging and acceptable to excellent vacuum drawdown times.

The invention has been described in detail with particular reference to preferred embodiments thereof, but it will be understood that variations and modifications can be effected within the spirit and scope of the invention.

What is claimed is:

1. An ablative recording element comprising a support having thereon a dye layer comprising a dye dispersed in a polymeric binder and solvent, said dye layer having an infrared-absorbing material associated therewith, and wherein said dye layer also contains polymeric dye-absorbing beads which can be:

a) beads which are swellable in said solvent and which are covalently crosslinked to an extent which does not exceed $1\times10^{-4}$ mole of crosslink per gram of polymer; or b) beads which have a porosity of at least 150 $m^2$/gram, said polymeric beads comprising polymers and copolymers of divinylbenzene, styrene/divinylbenzene, t-butylstyrene/divinylbenzene, methyl methacrylate/ethylene dimethacrylate, or ethylene dimethacrylate.

2. The element of claim 1 wherein said dye-absorbing beads are present at a coverage of from about 0.004 g/$m^2$ to about 0.1 g/$m^2$.

3. The element of claim 1 wherein said infrared-absorbing material is a dye which is contained in said dye layer.

4. The element of claim 1 wherein said support is transparent.

5. The element of claim 1 wherein said infrared-absorbing material is a pigment which is contained in said dye layer.

6. A process of forming a single color, ablation image comprising imagewise heating by means of a laser, a ablative recording element comprising a support having thereon a dye layer comprising a dye dispersed in a polymeric binder and solvent, said dye layer having an infrared-absorbing material associated therewith, and wherein said dye layer also contains polymeric dye-absorbing beads which can be:

a) beads which are swellable in said solvent and which are covalently crosslinked to an extent which does not exceed $1\times10^{-4}$ mole of crosslink per gram of polymer; or b) beads which have a porosity of at least 150 $m^2$/gram, said polymeric beads comprising polymers and copolymers of divinylbenzene, styrene/divinylbenzene, t-butylstyrene/divinylbenzene, methyl methacrylate/ethylene dimethacrylate, or ethylene dimethacrylate.

7. The process of claim 6 wherein said dye-absorbing beads are present at a coverage of from about 0.004 g/$m^2$ to about 0.1 g/$m^2$.

8. The process of claim 6 wherein said infrared-absorbing material is a dye which is contained in said dye layer.

9. The process of claim 6 wherein said support is transparent.

10. The process of claim 6 wherein said infrared-absorbing material is a pigment which is contained in said dye layer.

11. An ablative recording element comprising a support having thereon a dye layer comprising a dye dispersed in a polymeric binder and solvent, said dye layer having an infrared-absorbing material associated therewith, and wherein said dye layer also contains polymeric dye-absorbing beads which are swellable in said solvent and which are covalently crosslinked to an extent which does not exceed $1\times10^{-4}$ mole of crosslink per gram of polymer.

12. The element of claim 11 wherein said dye-absorbing beads are comprised of a vinyl polymer.

13. The element of claim 12 wherein said vinyl polymer is divinylbenzene, styrene/divinylbenzene copolymer, t-butylstyrene/divinylbenzene copolymer, methyl methacrylate/ethylene dimethacrylate copolymer, or ethylene dimethacrylate.

14. A process of forming a single color, ablation image comprising imagewise heating by means of a laser, a ablative recording element comprising a support having thereon a dye layer comprising a dye dispersed in a polymeric binder and solvent, said dye layer having an infrared-absorbing material associated therewith, and wherein said dye layer also contains polymeric dye-absorbing beads which are swellable in said solvent and which are covalently crosslinked to an extent which does not exceed $1\times10^{-4}$ mole of crosslink per gram of polymer.

15. The process of claim 14 wherein said dye-absorbing beads are comprised of a vinyl polymer.

16. The element of claim 15 wherein said vinyl polymer is divinylbenzene, styrene/divinylbenzene copolymer, t-butylstyrene/divinylbenzene copolymer, methyl methacrylate/ethylene dimethacrylate copolymer, or ethylene dimethacrylate.

* * * * *